US008211190B2

(12) United States Patent
Caprotti et al.

(10) Patent No.: US 8,211,190 B2
(45) Date of Patent: Jul. 3, 2012

(54) FUEL OIL COMPOSITIONS

(75) Inventors: Rinaldo Caprotti, Oxford (GB); Brid Dilworth, Dublin (IE); Carlo S. Fava, Oxford (GB); Philip Collier, Oxford (GB)

(73) Assignee: Infineum International Limited (GB)

( * ) Notice: Subject to any disclaimer, the term of this patent is extended or adjusted under 35 U.S.C. 154(b) by 1052 days.

(21) Appl. No.: 11/110,505

(22) Filed: Apr. 20, 2005

(65) Prior Publication Data

US 2005/0188606 A1 Sep. 1, 2005

Related U.S. Application Data

(63) Continuation of application No. 09/937,442, filed on Jan. 9, 2002, now abandoned.

(30) Foreign Application Priority Data

Mar. 26, 1999 (GB) ..... 9907058.3

(51) Int. Cl.
*C10L 1/12* (2006.01)

(52) U.S. Cl. ..... 44/358; 44/361; 44/362; 44/363; 44/365; 44/373; 44/385

(58) Field of Classification Search ..... 44/358, 44/361, 362, 363, 365, 373, 385
See application file for complete search history.

(56) References Cited

U.S. PATENT DOCUMENTS

| | | | | |
|---|---|---|---|---|
| 3,883,320 | A | 5/1975 | Strukl | 44/68 |
| 6,003,303 | A * | 12/1999 | Peter-Hoblyn et al. | 60/274 |
| 6,652,609 | B1 | 11/2003 | Caprotti | 44/370 |
| 7,524,338 | B2 * | 4/2009 | Pedrazzini | 44/365 |

FOREIGN PATENT DOCUMENTS

| | | | |
|---|---|---|---|
| EP | 0 476 196 | A1 | 3/1992 |
| EP | 1 173 530 | B1 | 11/2004 |
| GB | 861794 | | 2/1961 |
| GB | 888325 | | 1/1962 |
| GB | 2091291 | A | 7/1982 |
| GB | 2248068 | A | 3/1992 |
| WO | WO87/01126 | A1 | 2/1987 |
| WO | WO94/11467 | A1 | 5/1994 |
| WO | WO97/04045 | A1 | 2/1997 |
| WO | WO97/40122 | A1 | 10/1997 |
| WO | WO99/03953 | A1 | 1/1999 |
| WO | WO021417 | * | 2/2002 |

* cited by examiner

*Primary Examiner* — Cephia D Toomer

(57) ABSTRACT

This invention relates to fuel oil, especially middle distillate fuel oil, compositions comprising middle distillate fuel oil and incorporated therein an incorporated therein an additive composition comprising (a) at least one fuel-soluble or fuel-dispersible neutral alkaline earth metal compound and/or at least one fuel-soluble or fuel-dispersible neutral alkali metal compound, and (b) at least one fuel-soluble or fuel-dispersible transition metal compound, characterized in that the fuel oil composition contains at most 0.05 mass % of sulfur, the total metal content derived from (a) and (b) in the fuel oil composition is at most 50 ppm by mass, and the mass proportion of (a) to (b), based on metal content, is in the range of from 1:99 to 99:1.

19 Claims, No Drawings

FUEL OIL COMPOSITIONS

This application is a continuation of co-pending application Ser. No. 09/937,442, which was filed Jan. 9, 2002 now abandoned.

This invention relates to fuel oil, especially middle distillate fuel oil, compositions of improved performance.

More demanding requirements are being placed on fuel oil combustion devices, such as diesel engines, for improved performance, particularly in the areas of particulate matter emission and smoke reduction, reduced engine wear and improved fuel economy.

Combustors, such as heating units, fueled by liquid fuels are also prone to emission of unburned or partially unburned substances especially when operated on a frequent start-stop programme or when the burner parts are inadequately maintained. As energy regulations become more stringent the emissions by such units need also to be minimised.

The use of additives, including metallic additives, in fuel oils to improve its performance is well known. Certain organometallic compounds are known to be effective combustion improvers for distillate fuels such as home heating oils. For example, U.S. Pat. No. 3,112,789 describes the use of cyclopentadienyl manganese tricarbonyls for this purpose. While GB-A-1,090,289 and U.S. Pat. No. 3,637,356 describe the use of calcium compounds for reducing smoke.

EP-B-0 476 196 describes an additive composition for hydrocarbonaceous fuel comprising (a) one or more fuel-soluble manganese carbonyl compounds;

(b) one or more fuel-soluble alkali or alkaline earth metal containing detergents; and (c) one or more fuel-soluble ashless dispersants;

and its use for reducing the soot, smoke and/or carbonaceous products produced on combustion of the fuel and for reducing the acidity of the carbonaceous products.

Canadian Patent No. 1,188,891 describes an additive comprising at least one oil-soluble and/or dispersible compound of a transition metal and/or alkaline earth metal as well as one of several inhibitors against polymerisation and oxidation of hydrocarbons which inhibits the formation of soot. Examples 1 and 2 disclose compositions containing overbased (carbonated) barium sulfonate.

GB-A-2 248 068 discloses an additive for reducing smoke and particulate emissions during combustion of a fuel oil which comprises:

(a) a compound of an alkali metal;

(b) a compound of a metal of group 2a of the Periodic Table; and (c) a compound of a transition metal selected from groups 1b, 3b, 4b, 5b, 6b, 7b and 8 of the Periodic Table.

GB-A-2 321 906 discloses a fuel additive comprising (a) a calcium salt and (b) an alkali and/or alkaline earth metal salt other than one of calcium.

WO 96/34074, WO 96/34075 and WO 97/40122 disclose fuel additives for reducing the emission of particulates.

GB-A-2 091 291 discloses an additive for a diesel fuel oil, which comprises a fuel oil soluble or dispersible calcium compound and a fuel oil soluble or dispersible iron compound, for smoke suppression.

These references, however, do not disclose the defined composition of the present invention.

Further, environmental concerns have led to a need for fuels with reduced sulfur content, especially diesel fuel and kerosene, which have resulted in an increase in the number of reported problems in fuel pumps in diesel engines. The problems are caused by wear in, for example, cam plates, rollers, spindles and drive shafts, and include sudden pump failures relatively early in the life of the engine. Historically, the sulfur content in a diesel fuel was a maximum of 0.2% by weight in Europe, but recently sulfur levels have been reduced to at most 0.05% by weight, and further reductions are expected.

The performance specifications for fuel oils, such as diesel fuel oils, are also being regularly revised with tighter targets and fewer debits. For example, fuel oil compositions demonstrating control of haze and/or foaming tendency are sought.

There is, therefore, a constant need for fuel oil compositions with improved performance to meet the developments in environmental and performance regulations; this is especially the case for the middle distillate fuel oils, such as diesel fuel oils and heating oils.

Further, there is an on-going demand to minimise the cost of additives used, and reduce the amount of metals used in fuel oils, for example, in order to reduce the formation of ash deposits upon combustion.

The present invention meets this need by providing a fuel oil composition comprising middle distillate fuel oil and incorporated therein an additive composition comprising at least two or more compounds selected from the group consisting of (i) at least one fuel-soluble or fuel-dispersible neutral alkaline earth metal compound, (ii) at least one fuel-soluble or fuel-dispersible neutral alkali metal compound, and (iii) at least one fuel-soluble or fuel-dispersible transition metal compound. It has been surprisingly found that such a fuel oil composition provides better performance than fuel oil compositions comprising any one of the compounds (i) to (iii).

Accordingly, a first aspect of the present invention is a fuel oil composition comprising middle distillate fuel oil and incorporated therein an additive composition comprising (a) at least one fuel-soluble or fuel-dispersible neutral alkaline earth metal compound and/or at least one fuel-soluble or fuel-dispersible neutral alkali metal compound, and (b) at least one fuel-soluble or fuel-dispersible transition metal compound, characterised in that the fuel oil composition contains at most 0.05 mass % of sulfur, the total metal content derived from (a) and (b) in the fuel oil composition is at most 50 ppm by mass, and the mass proportion of (a) to (b), based on metal content, is in the range of from 1:99 to 99:1.

A second aspect of the present invention is a heating oil composition comprising heating oil and incorporated therein an additive composition comprising (a) at least one fuel-soluble or fuel-dispersible neutral alkaline earth metal compound and/or at least one fuel-soluble or fuel-dispersible neutral alkali metal compound, and (b) at least one fuel-soluble or fuel-dispersible transition metal compound, characterised in that the fuel oil composition contains at most 0.2 mass % of sulfur, the total metal content derived from (a) and (b) in the heating oil composition is at most 50 ppm by mass, and the mass proportion of (a) to (b), based on metal content, is in the range of from 1:99 to 99:1.

A third aspect of the present invention a process for reducing particulate matter emissions and/or smoke during operation of a fuel oil combustion device which comprises adding to the device a fuel oil composition as defined in the first or second aspect.

A fourth aspect of the present invention is the use of a fuel oil composition as defined in the first or second aspect to reduce particulate matter emissions during operation of a fuel oil combustion device.

Fuel Oils

In principle, the advantages of this invention may be achieved in any distilled or distillable liquid hydrocarbonaceous fuel derived from petroleum, coal, shale and/or tar sands and bio-fuel. In most instances, at least under present circumstances, the base fuels will be derived primarily, if not exclusively, from petroleum.

The invention is thus applicable to such fuels as gasoline, kerosine, jet fuel, aviation fuel, diesel fuel, home heating oil, light cycle oil, heavy cycle oil, light gas oil, heavy gas oil, and in general, any liquid hydrocarbonaceous product suitable for combustion in either an engine or in a burner apparatus.

Middle distillate fuel oils, as a class of fuels, generally boil within the range of about 100° C. to about 500° C., e.g. 150° to about 400° C., for example, those having a relatively high Final Boiling Point of above 360° C. (ASTM D-86). Middle distillates contain a spread of hydrocarbons boiling over a temperature range, including n-alkanes which precipitate as wax as the fuel cools. They may be characterised by the temperatures at which various %'s of fuel have vaporised, e.g. 10% to 90%, being the interim temperatures at which a certain volume % of initial fuel has distilled. The difference between say 90% and 20% distillation temperature may be significant. They are also characterised by pour, cloud and CFPP points, as well as their initial boiling point (IBP) and final boiling point (FBP). The petroleum fuel oil can comprise atmospheric distillate or vacuum distillate, or cracked gas oil or a blend in any proportion of straight run and thermally and/or catalytically cracked distillates. The most common middle distillate fuels are jet fuels, diesel fuels and heating oils.

The heating oil may be a straight atmospheric distillate, or it may contain minor amounts, e.g. up to 35 mass %, of vacuum gas oil or cracked gas oils or of both. Heating oils may be made of a blend of virgin distillate, e.g. gas oil, naphtha, etc. and cracked distillates, e.g. catalytic cycle shock.

A representative specification for a diesel fuel includes a minimum flash point of 38° C. and a 90% distillation point between 282 and 380° C. (see ASTM Designations D-396 and D-975).

The fuel oil may also be an animal or vegetable oil, or a mineral oil as described above in combination with an animal or vegetable oil. Fuels from animal or vegetable sources are known as biofuels and are believed to be less damaging to the environment on combustion, and are obtained from a renewable source. It has been reported that on combustion less carbon dioxide is formed than is formed by the equivalent quantity of petroleum distillate fuel, e.g. diesel fuel, and very little sulfur dioxide is formed. Certain derivatives of vegetable oil, for example rapeseed oil, e.g. those obtained by saponification and re-esterification with a monohydric alcohol, may be used as a substitute for diesel fuel. It has recently been reported that mixtures of a rapeseed ester, for example, rapeseed methyl ester (RME), with petroleum distillate fuels in ratios of, for example, 10:90 by volume are likely to be commercially available in the near future.

Thus, a biofuel is a vegetable or animal oil or both or a derivative thereof, particularly an oil comprising fatty acid and/or fatty acid esters. Vegetable oils are mainly triglycerides of monocarboxylic acids, e.g. acids containing 10-25 carbon atoms and listed below

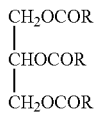

where R is an aliphatic radical of 10-25 carbon atoms which may be saturated or unsaturated.

Generally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids partially esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 mass % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 mass % from unsaturated fatty acids with 18 carbon atoms, are preferred.

Preferably the biofuel is present in an amount of up to 50 mass % based on the mass of the middle distillate fuel oil, more preferably of up to 10 mass %, especially up to 5 mass %.

The fuel oil composition, for example, diesel fuel oil, generally has a sulfur level of 0.2 mass % or less (as measured by X-ray Fluorescence according to ASTM D2622-94) based on the mass of the fuel oil composition. Preferably, the fuel oil composition contains at most 0.1 mass % of sulfur; more preferably at most 0.05 mass %; advantageously at most 0.04 mass %; more advantageously at most 0.03 mass %; especially at most 0.02 mass %; such as less than 0.01 mass % of sulfur. Fuels oil compositions containing even lower sulfur levels, for example 75 ppm by mass or less, 50 ppm or less and 25 ppm or less, are also within the scope of the present invention.

Typically the heating oil compositions of the present invention contain a sulfur level of at most 0.2 mass % (as measured by X-ray Fluorescence according to ASTM D2622-94) based on the mass of the heating oil composition. Preferably, the heating oil composition contains at most 0.1 mass % of sulfur; more preferably at most 0.05 mass %; advantageously at most 0.04 mass %.

The art describes methods for reducing the sulfur concentration of hydrocarbon middle distillate fuels, such methods including solvent extraction, sulfuric acid treatment, and hydrodesulfurisation.

Fuel oils having such low sulfur levels show good response to the additive compositions of the present invention despite the reduced tendency of such fuel oils to produce particulate emissions.

Hydrocarbon middle distillate fuel oils, as used herein refers to middle distillate fuel oils which are substantially free, and preferably free, of ethers and/or alcohols. As used herein the term 'substantially free' with reference to ethers and/or alcohols in fuel oil refers to an amount of up to 20 mass % based on the mass of the middle distillate fuel oil, preferably up to 10 mass %, more preferably up to 5 mass %.

Preferably, the fuel oil is middle distillate fuel, such as a hydrocarbon middle distillate fuel oil; more preferably, the fuel oil is diesel fuel oil or heating oil.

Combustion Devices

In all aspects of the present invention, the fuel oil compositions can be used in combustion devices operated by compression ignition mechanisms, as well as those operated by non-compression mechanisms.

An example of a combustion device operated by compression ignition mechanism is the internal combustion engine which is used to power mobile vehicles. While an example of a non-compression combustion device is a stationary burner.

Neutral Alkaline Earth Metal and Neutral Alkali Metal Compounds

The type of neutral alkaline earth metal and neutral alkali metal compounds of the present invention is not important provided that the combination of the compounds making up the additive compositions of the present invention (including the transition metal compound) are soluble or dispersible in the fuel oil in which it is to be used at the concentration in which it is to be used.

In all aspects of the invention, the alkaline earth metal particularly suitable in the present invention is selected from the group consisting of calcium and magnesium. Preferably the alkaline earth metal compound is a calcium compound.

In all aspects of the invention, the alkali metal particularly suitable in the present invention is selected from the group consisting of lithium, sodium and potassium. Preferably the alkali metal compound is a sodium or potassium compound, more preferably a sodium compound.

Preferably the neutral alkaline earth metal and neutral alkali metal compounds are salts of organic acids. As examples of organic acids, there may be mentioned carboxylic acids and anhydrides thereof, phenols, sulfurised phenols, salicylic acids and anhydrides thereof, alcohols, dihydrocarbyldithiocarbamic acids, dihydrocarbyldithiophosphoric acids, dihydrocarbylphosphonic acids, dihydrocarbylthiophosphonic acids and sulfonic acids.

The term 'neutral' as used herein refers to metal compounds, preferably metal salts of organic acids, that are stoichiometric or predominantly neutral in character, that is most of the metal is associated with an organic anion. For a metal compound to be completely neutral, the total number of moles of the metal cation to the total number of moles of organic anion associated with the metal will be stoichiometric. For example, for every one mole of calcium cations there should be two moles of sulfonate anions.

The metal salts of the present invention include predominantly neutral salts where minor amounts of non-organic anions, for example carbonate and/or hydroxide anions, may also be present provided their presence does not alter the predominantly neutral character of the metal salt.

Thus, metal salts of the present invention preferably have a metal ratio of less than 2, more preferably less than 1.95, especially less than 1.9, advantageously less than 1.8, more especially less than 1.6, for example less than 1.5, such as less than 1.4 or less than 1.35. The metal ratio is preferably at least about 1.0. The metal ratio, as used herein, is the ratio of total metal to the metal associated with the organic anion. So metal salts having a metal ratio of less than 2 have greater than 50% of the metal associated with the organic anion.

The metal ratio can be calculated by a) measuring the total amount of metal in the neutral metal salt; and then b) determining the amount of metal associated with the organic.

Suitable methods for measuring the total metal content are well known in the art and include X-ray fluorescence and atomic absorption spectrometry.

Suitable methods for determining the amount of metal associated with the organic acid include potentiometric acid titration of the metal salt to determine the relative proportions of the different basic constituents (for example, metal carbonate and metal salt of organic acid); hydrolysis of a known amount of metal salt and then the potentiometric base titration of the organic acid to determine the equivalent moles of organic acid; and determination of the non-organic anions, such as carbonate, by measuring the $CO_2$ content.

In the case of a metal sulfonate, ASTM D3712 may be used to determine the metal associated with the sulfonate.

In the instance where a composition comprises one or more neutral metal salts and one or more co-additives, then the neutral metal salt(s) may be separated from the co-additives, for example, by using dialysis techniques and then the neutral metal salt may be analysed as described above to determine the metal ratio. Background information on suitable dialysis techniques is given by Amos, R. and Albaugh, E. W. in "Chromatography in Petroleum Analysis" Altgelt, K. H. and Gouw, T. H., Eds., pages 417 to 421, Marcel Dekker Inc., New York and Basel, 1979.

Specific examples of organic acids include surfactant molecules, examples of which are hydrocarbyl sulfonic acids, hydrocarbyl substituted phenols, hydrocarbyl substituted sulfurised phenols, hydrocarbyl substituted salicylic acids, dihydrocarbyldithiocarbamic acid, dihydrocarbyldithiophosphoric acid, and aliphatic and aromatic carboxylic acids.

The neutral metal salts of the present invention may be salts of one type of surfactant or salts of more than one type of surfactant. Preferably, they are salts of one type of surfactant.

Sulfonic acids used in accordance with this aspect of the invention are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from about 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulfonic acids usually contain from about 22 to about 100 or more carbon atoms; preferably the alkylaryl sulfonic acids contain at least 26 carbon atoms, especially at least 28, such as at least 30, carbon atoms. The sulfonic acids may be substituted by more than one alkyl group on the aromatic moiety, for example they may be dialkylaryl sulfonic acids. The alkyl group preferably contains from about 16 to about 80 carbon atoms, with an average number of carbon atoms in the range of from 36-40, or an average carbon number of 24, depending on the source from which the alkyl group is obtained. Preferably the sulfonic acid has a number average molecular weight of 350 or greater, more preferably 400 or greater, especially 500 or greater, such as 600 or greater. Number average molecular weight may be determined by ASTM D3712.

When neutralising these alkylaryl sulfonic acids to provide sulfonates, hydrocarbon solvents and/or diluent oils may also be included in the reaction mixture, as well as promoters.

Another type of sulfonic acid which may be used in accordance with the invention comprises alkyl phenol sulfonic acids. Such sulfonic acids can be sulphurized. Preferred substituents in alkyl phenol sulfonic acids are substituents represented by R in the discussion of phenols below.

Sulfonic acids suitable for use in accordance with the invention also include alkyl sulfonic acids. In such compounds the sulfonic acid suitably contains 22 to 100 carbon atoms, advantageously 25 to 80 carbon atoms, especially 30 to 60 carbon atoms.

Preferably the sulfonic acid is hydrocarbyl-substituted aromatic sulfonic acid, more preferably alkyl aryl sulfonic acid.

Phenols used in accordance with the invention may be non-sulphurized or, preferably, sulphurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols from which neutral calcium and/or magnesium salts in accordance with the invention may be derived are of the formula

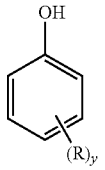

where R represents a hydrocarbyl group and y represents 1 to 4. Where y is greater than 1, the hydrocarbyl groups may be the same or different.

The phenols are frequently used in sulphurized form. Sulphurized hydrocarbyl phenols may typically be represented by the formula:

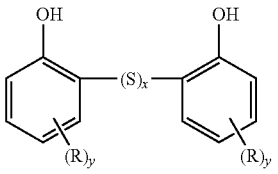

where x, represents an integer from 1 to 4. In some cases, more than two phenol molecules may be linked by $(S)_x$ bridges, where S represents a sulfur atom.

In the above formulae, hydrocarbyl groups represented by R are advantageously alkyl groups, which advantageously contain 5 to 100 carbon atoms, preferably 5 to 40 carbon atoms, especially 9 to 12 carbon atoms, the average number of carbon atoms in all of the R groups being at least about 9 in order to ensure adequate solubility or dispersibility in oil. Preferred alkyl groups are nonyl (e.g. tripropylene) groups or dodecyl (e.g. tetrapropylene) groups.

In the following discussion, hydrocarbyl-substituted phenols will for convenience be referred to as alkyl phenols.

A sulfurizing agent for use in preparing a sulphurized phenol or phenate may be any compound or element which introduces $—(S)_x—$ bridging groups between the alkyl phenol monomer groups, wherein x is generally from 1 to about 4. Thus, the reaction may be conducted with elemental sulfur or a halide thereof, for example, sulfur dichloride or, more preferably, sulfur monochloride. If elemental sulfur is used, the sulfurisation reaction may be effected by heating the alkyl phenol compound at from 50 to 250° C., and preferably at least 100° C. The use of elemental sulfur will typically yield a mixture of bridging groups $—(S)_x—$ as described above. If a sulfur halide is used, the sulfurisation reaction may be effected by treating the alkyl phenol at from −10° C. to 120° C., preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulfurizing agent.

Where elemental sulfur is used as the sulfurizing agent, it may be desirable to use a basic catalyst, for example, sodium hydroxide or an organic amine, preferably a heterocyclic amine (e.g., morpholine).

Details of sulfurisation processes are well known to those skilled in the art, for example U.S. Pat. Nos. 4,228,022 and 4,309,293.

As indicated above, the term "phenol" as used herein includes phenols which have been modified by chemical reaction with, for example, an aldehyde, and Mannich base-condensed phenols.

Aldehydes with which phenols used in accordance with the invention may be modified include, for example, formaldehyde, propionaldehyde and butyraldehyde. The preferred aldehyde is formaldehyde. Aldehyde-modified phenols suitable for use in accordance with the present invention are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above. Examples of such substituents are methoxy groups and halogen atoms.

Salicylic acids used in accordance with the invention may be non-sulphurized or sulphurized, and may be chemically modified and/or contain additional substituents, for example, as discussed above for phenols. Processes similar to those for phenols may also be used for sulfurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which neutral calcium and/or magnesium salts in accordance with the invention may be derived are the substituents represented by R in the above discussion of phenols. In alkyl-substituted salicylic acids, the alkyl groups advantageously contain 5 to 100 carbon atoms, preferably 9 to 30 carbon atoms, especially 14 to 20 carbon atoms.

Alcohols which may be used are mono- and polyols. The alcohols preferably have sufficient number of carbon atoms to provide adequate oil solubility or dispersibility to a metal salt thereof. Preferred alcohols have at least 4 carbon atoms, an example of which is tertiary butyl alcohol.

Carboxylic acids which may be used in accordance with the invention include mono- and dicarboxylic acids. Preferred monocarboxylic acids are those containing 8 to 30 carbon atoms, especially 8 to 24 carbon atoms. (Where this specification indicates the number of carbon atoms in a carboxylic acid, the carbon atom(s) in the carboxylic group(s) is/are included in that number.) Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the α-carbon atom and dicarboxylic acids with 2 or more carbon atoms separating the carboxylic groups. Further, dicarboxylic acids with more than 35 carbon atoms, for example, 36 to 100 carbon atoms, are also suitable. Unsaturated carboxylic acids can be sulphurized.

Specific examples of carboxylic acids include alkyl and alkenyl succinic acids and anhydrides thereof. Also applicable are aromatic carboxylic acids such as naphthenic acids and hydrocarbyl derivatives thereof.

The organic acids described in GB-A-2,248,068 are herein incorporated by reference.

In the instance where more than one type of surfactant is present in the metal salt, the proportion of any one type of surfactant to another is not critical provided the neutral character of the metal is not altered.

It will be appreciated by one skilled in the art that a single type of surfactant may contain a mixture of surfactants of the same type. For example, a sulfonic acid surfactant may contain a mixture of sulfonic acids of varying molecular weights. Such a surfactant composition is considered as one type of surfactant.

As used in this specification the term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and, preferably, oxygen.

In all aspect of the invention, the Total Base Number (TBN), as measured according to ASTM D2896, of the neutral alkaline earth metal compounds and neutral alkali metal compounds is at most 100, preferably at most 80, more preferably at most 70, advantageously at most 60, such as less than 50.

In all aspects of the invention, a preferred neutral alkaline earth metal compound is calcium sulfonate or calcium salicylate; especially preferred is a calcium sulfonate.

In all aspects of the invention, a preferred neutral alkali metal compound is selected from the group consisting of sodium sulfonate, sodium salicylate, potassium sulfonate and potassium salicylate.

Transition Metal Compounds

The type of transition metal compounds of the present invention is not important provided that the combination of the compounds making up the additive composition of the present invention (as defined in the first or second aspect) is soluble or dispersible in the fuel oil in which it is to be used at the concentration in which it is to be used.

In all aspects of the invention, the transition metal is preferably selected from the group consisting of iron, manganese, copper, molybdenum, cerium, chromium, cobalt, nickel, zinc, vanadium and titanium; more preferably, the transition metal is iron.

The compound of the transition metal is preferably selected from an organic acid salt of a transition metal; ferrocene ($Fe[C_5H_5]_2$) or a derivative thereof; and a manganese carbonyl compound or a derivative thereof.

The organic acids suitable for the transition metal are the same as those described above for the neutral alkaline earth metal and alkali metals. Specific examples of preferred transition metal compounds of organic acids are iron naphthenate, iron oleate, copper naphthenate, copper oleate, copper dithiocarbamate, copper dithiophosphate, zinc dithiophosphate, zinc dithiocarbamate, molybdenum dithiocarbamate, molybdenum dithiophosphate, cobalt naphthenate, cobalt oleate, nickel oleate, nickel naphthenate, manganese naphthenate and manganese oleate. Also suitable are alkenyl and alkyl succinate salts of iron, copper, cobalt nickel and manganese.

Other examples of transition metal compounds are π-bonded ring compounds where the number of carbon atoms in the ring may be in the range of from 2 to 8, such as $[C_5H_5]$, $[C_6H_6]$, $[C_8H_8]$. Examples are dibenzenechromium and dicyclopentadienyl manganese. Transition metal compounds with one π-bonded ring and other ligands such as halogens, CO, RNC annd $R_3P$ (where R is a hydrocarbyl group and may be the same or different when there is more than one R group) are also within the scope of the invention. The π-bonded ring may be heterocyclic such as $[C_4H_4N]$, $[C_4H_4P]$ and $[C_4H_4S]$.

Examples of iron compounds include iron (II) and iron (III) compounds, and derivatives of ferrocene such as bis(alkyl substituted cyclopentadienyl) iron compounds, for example bis(methyl cyclopentadienyl) iron. Also compounds such as cyclopentadienyl iron carbonyl compounds, for example, $[C_5H_5]Fe(CO)_3$ and $[C_5H_5]Fe(CO)_2Cl$; $[C_5H_5][C_4H_4N]Fe$; and $[C_5H_5][C_4H_4P]Fe$ are suitable in the present invention.

Examples of manganese compounds and derivatives thereof include those described in EP-A-0,476,196 which are incorporated herein by reference. Specific examples are cyclopentadienyl manganese carbonyl compounds such as cyclopentadienyl manganese tricarbonyl and methyl cyclopentadienyl manganese tricarbonyl.

In an aspect of the present invention, the fuel oil composition does not comprise a manganese compound.

In all aspects of the invention, the fuel-soluble or fuel-dispersible transition metal compound is preferably ferrocene.

In the instance where two or more metal compounds are present in the additive composition from any one of the categories of metal compounds, that is (i) neutral alkaline earth metal compounds, (ii) neutral alkali metal compounds and (iii) transition metal compounds, the compounds may be of the same or of different metals within the category.

Concentration and Proportion

In all aspects of the invention, the total amount of metal by mass, derived from the or each neutral alkaline earth metal compound and/or the or each neutral alkali metal compound, in the fuel oil composition is at most 25 ppm; preferably the total amount of metal is at most 20 ppm, more preferably at most 15 ppm; advantageously at most 10 ppm; especially at most 7 ppm, such as at most 5 ppm, for example in the range of from 0.1 to 3 ppm or 0.5 to 3 ppm.

In all aspects of the invention, the total amount of metal by mass, derived from the or each transition metal compound, in the fuel oil composition is at most 25 ppm; preferably the total amount of metal is at most 20 ppm, more preferably at most 15 ppm; advantageously at most 10 ppm; especially at most 7 ppm, such as at most 5 ppm, for example in the range of from 0.1 to 3 ppm or 0.5 to 3 ppm.

Accordingly, the total amount of metal by mass, derived from the neutral alkaline earth metal compound and/or neutral alkali metal compound and transition metal compound, in the fuel oil composition, in all aspects of the invention, is preferably in the range of from 0.1 to 50 ppm; preferably from 0.1 to 40 ppm; more preferably from 0.1 to 30 ppm; advantageously from 0.1 to 20 ppm; more advantageously from 0.5 to 10 ppm; especially from 0.5 to 9 ppm; such as from 0.5 to 8 ppm. Also advantageous are fuel oil compositions wherein the total amount of metal by mass, derived from the neutral alkaline earth metal compound and/or neutral alkali metal compound and transition metal compound, in the fuel oil composition is in the range of from 0.5 to 7 ppm, preferably from 0.75 to 6 ppm, advantageously from 1 to 5 ppm, such as from 1 to 4 ppm.

The amount of alkaline earth metal in the fuel oil composition is measured by atomic absorption; the amount of alkali metal in the fuel oil composition is measured by atomic absorption; and the amount of transition metal in the fuel oil composition is measured by atomic absorption.

A surprising feature of the present invention is that lower amounts of metal can be used in the fuel oil to achieve improved performance of the fuel oil.

In all aspects of the invention, the mass proportion, based on metal content, of (a) neutral alkaline earth metal compound and/or neutral alkali metal compound to (b) transition metal compound is preferably in the range of from 10:90 to 90:10; more preferably in the range of from 20:80 to 80:20; advantageously from 30:70 to 70:30; for example in the range of from 40:60 to 60:40; more advantageously in the range of from 50:50 to 95:5; especially in the range of from 60:40 to 95:5; more especially in the range of from 70:30 to 95:5; such as in the range of from 80:20 to 95:5; for example in the range of from 80:20 to 90:10.

It has been found that a particular proportion of (a) to (b) provides improved performance and that a higher proportion of the metal derived from (a) is preferred.

Additive Composition

The additive composition or concentrate comprising the metal compounds of the present invention may be in admixture with a carrier liquid (e.g. as a solution or a dispersion). Such concentrates are convenient as a means for incorporating the metal compounds into bulk fuel oil such as distillate fuel oil, which incorporation may be done by methods known in the art. The concentrates may also contain other fuel additives as required and preferably contain from 1 to 75 mass %, more preferably 2 to 60 mass %, most preferably 5 to 50 mass % of the additives, based on active ingredient, preferably in solution in the carrier liquid. Examples of carrier liquids are organic solvents including hydrocarbon solvents, for example petroleum fractions such as naphtha, kerosene, lubricating oil, diesel fuel oil and heater oil; aromatic hydrocarbons such as aromatic fractions, e.g. those sold under the 'SOLVESSO' tradename; and paraffinic hydrocarbons such as hexane and pentane and isoparaffins. The carrier liquid must, of course, be selected having regard to its compatibility with the additives and with the fuel oil.

The metal compounds of the present invention may be incorporated into the bulk fuel oil by other methods such as those known in the art. If co-additives are required, they may be incorporated into the bulk fuel oil at the same time as the metal compounds of the present invention or at a different time.

Accordingly, the present invention also provides a process for preparing a fuel oil composition as defined in the first or second aspect wherein the additive composition as defined in the first or second aspect is incorporated, preferably by blending or mixing, into a fuel oil, or the metal compounds of the present invention are incorporated , preferably by blending or mixing, into the fuel oil contemporaneously or sequentially.

Co-Additives

The metal compounds of the present invention may be used in combination with one or more co-additives such as known in the art, for example the following: cold flow improvers, wax anti-settling agents, detergents, dispersants, antioxidants, corrosion inhibitors, dehazers, demulsifiers, metal deactivators, antifoaming agents, cetane improvers, cosolvents, package compatibilisers, other lubricity additives and antistatic additives. A particularly preferred co-additive is a polyisobutenyl succinimide.

It should be appreciated that interaction may take place between any two or more of the metal compounds of the present invention after they have been incorporated into the fuel oil or additive composition, for example, between two different neutral alkaline earth metal compounds or between a neutral alkaline earth metal compound and a neutral alkali metal or between a neutral alkaline earth metal compound and a transition metal compound or between a neutral alkaline earth metal compound, a neutral alkali metal compound and a transition metal compound. The interaction may take place in either the process of mixing or any subsequent condition to which the composition is exposed, including the use of the composition in its working environment. Interactions may also take place when further auxiliary additives are added to the compositions of the invention or with components of fuel oil. Such interaction may include interaction which alters the chemical constitution of the metal compounds. Thus for example the compositions of the invention include compositions in which interaction between any of the metal compounds has occurred, as well as compositions in which no interaction has occurred between the components mixed in the fuel oil.

The terms "comprising" or "comprises" when used herein is taken to specify the presence of stated features, integers, steps or components, but does not preclude the presence or addition of one or more other features, integers, steps, components or groups thereof.

The terms "fuel-soluble" or "fuel-dispersible", as used herein with respect to the metal compounds, does not mean that the metal compounds are soluble, dissolvable, miscible or capable of being suspended in the fuel oil in all proportions. They do mean, however, that the metal compounds of the present invention are, for instance, soluble or stable dispersible in the fuel oil to an extent sufficient to exert their intended effect in the environment in which the fuel oil composition is employed. Moreover, the additional incorporation of other additives such as those described above may affect the fuel solubility or dispersibility of the metal compounds of the invention.

It has been found that the specific combination of neutral alkaline earth metal compound and transition metal compound, in particular a neutral calcium compound and an iron compound, is effective in a diesel fuel oil or a heating oil. Preferably the neutral calcium compound is calcium sulfonate and preferably has a Total Base Number (TBN), as measured according to ASTM D2896, of at most 50, more preferably at most 30, such as at most 20; and the iron compound is preferably ferrocene.

An advantage of the present invention is that the use of expensive transition metal compounds in fuel oils can be minimised whilst still achieving effective performance, for example in the areas of particulate matter and/or smoke and lubricity.

Particulate matter emissions may be reduced by improved combustion of the fuel oil, which the metal compounds of the present invention play a role in promoting, and/or through after-treatment technologies of the exhaust gas, such as with a particulate trap. However, a drawback of the particulate trap method is the need for periodic regeneration of the trap to burn-off the deposited soot to keep the back-pressure within acceptable limits. This procedure makes the system costly, hard to control, and reduces the durability of the trap. The main problem in regenerating the trap is linked to the low exhaust gas temperature of diesel engines. The oxidation of diesel soot requires temperatures of about 600° C. which is difficult to attain. Use of organometallic additives to reduce the ignition temperature of the soot has been described in the SAE paper 922188 by B. Krutzsch and G. Wenninger. Interestingly, the metal compounds of the present invention may be useful in improving the regenerative ability of a particulate matter trap. Many types of the particulate traps are known to those skilled in the art including as non-limiting examples "cracked-wall" and "deep-bed" ceramic types and sintered metal types.

Thus, the present invention also provides a process for reducing particulate matter emissions by improving the regenerative ability of a particulate trap of a fuel oil combustion device which process comprises supplying directly to the trap an additive composition as defined in the first aspect, and/or adding to the fuel oil combustion device a fuel oil composition as defined in the first aspect.

Similarly, the use of an additive composition as defined in the first aspect, or a fuel oil composition as defined in the first aspect to reduce particulate matter emissions by improving the regenerative ability of a particulate trap of a fuel oil combustion device, is also disclosed herein.

Further, the present invention provides a method of operating an apparatus powered by a diesel engine which is equipped with an exhaust system particulate trap and optionally equipped with a fuel additive dispenser, which method comprises supplying to the diesel engine a fuel oil composition as defined in the first aspect or when a fuel dispenser is present, maintaining a fuel additive composition as defined in the first aspect in said dispenser and blending said additive composition with a diesel fuel during operation of the diesel engine.

In another aspect, the present invention provides a process for improving the combustion of a fuel oil and/or improving the oxidation of carbonaceous products derived from the combustion or pyrolysis of a fuel oil, which process comprises adding to the fuel oil before combustion or pyrolysis thereof an additive composition as defined in the first aspect or second aspect.

In a further aspect, the present invention provides the use of an additive composition, as defined in the first aspect or second aspect, in a fuel oil to improve the combustion of the fuel oil and/or to improve the oxidation of carbonaceous products derived from the combustion or pyrolysis of the fuel oil.

Treatment with the metal compounds of the present invention in such an amount that the total metal in the fuel oil composition is at most 50 ppm, such as 2 to 50 ppm, by mass based on metal may also prove to be effective in improving fuel lubricity, as measured in tests such as the HFRR (High Frequency Reciprocating Rig) test.

Accordingly, an aspect of the present invention provides for a process for improving lubricity performance of a fuel oil containing at most 0.05 mass % of sulfur which comprises adding to the fuel oil an additive composition as defined in the first aspect in such an amount that the metal content derived from (a) and (b) in the resulting fuel oil composition is at most 50 ppm by mass.

Another aspect of the present invention provides the use of an additive composition, as defined in the first aspect, in a fuel oil containing at most 0.05 mass % of sulfur in such an amount that the metal content derived from (a) and (b) in the resulting fuel oil composition is at most 50 ppm by mass, to improve the lubricity performance of the fuel oil.

Surprisingly, it has been found that the defined metal compounds of the present invention provide fuel oil, particularly diesel fuel oil and heating oil, compositions with improved low temperature flow performance compared to fuel oil compositions comprising the alkaline earth metal compounds alone, such as a neutral calcium compound. This effect is particularly apparent in the Cold Filter Plugging Point (CFPP) test (according to IP 309/96) or the Simulated Filter Plugging Point (SFPP) test (according to IP 419/96).

Further, the defined metal compounds of the present invention when added to fuel oil, such as diesel fuel oil or heating oil, provide the resulting compositions with better stability against water, thereby minimizing the formation of emulsions in the fuel oil compositions.

The haze forming tendencies of a fuel oil composition may be measured according to ASTM D1094.

That which is claimed is:

1. A process for improving the regenerative ability of a particulate trap of a fuel oil composition device, which process consists of:

supplying directly to the trap an additive composition and/or adding to the fuel oil combustion device a fuel oil composition incorporating an additive composition;

wherein the additive composition consists of:

(a) at least one fuel-soluble or fuel-dispersible alkaline earth metal compound selected from the group consisting of calcium sulfonate and calcium salicylate, and (b) at least one fuel-soluble or fuel-dispersible transition metal compound including a transition metal selected from the group consisting of iron, copper, cerium, chromium, cobalt and molybdenum; and wherein the fuel oil composition contains at most 0.05 mass percent of sulfur, the total metal content of the alkaline earth metal compound and the transition metal compound in the fuel oil composition is at most 50 ppm by mass, the mass proportion of metal in the alkaline earth metal compound to metal in the transition metal compound is in the range of about 60:40 to about 95:5, the alkaline earth metal compound includes an organic anion and metal associated with the organic anion, the ratio of metal in the alkaline earth compound to metal associated with the organic anion is less than about 2, and the fuel composition does not comprise a manganese compound.

2. The process of claim 1 in which the additive composition consists of at least one fuel-soluble or fuel-dispersible neutral calcium sulfonate or calcium salicylate and at least one fuel-soluble or fuel-dispersible iron compound.

3. The process of claim 1 in which the transition metal compound is selected from the group consisting of a salt of an organic acid, ferrocene or a derivative of ferrocene.

4. The process of claim 3 in which the organic acid is selected from the group consisting of carboxylic acid, carboxylic acid anhydride, alcohol, phenol, sulfurized phenol, salicylic acid and sulfonic acid.

5. The process of claim 1 in which the transition metal compound is ferrocene.

6. The process of claim 1 in which the mass proportion of the alkaline earth metal compound to the transition metal compound, based on metal content, is in the range of about 70:30 to about 95:5.

7. The process of claim 1 in which the total metal content by mass of the alkaline earth metal compound and the transition metal compound in the fuel oil composition is in the range of about 0.1 to about 50 ppm.

8. A process for improving the regenerative ability of a particulate trap of a fuel oil composition device, which process consists of:

supplying directly to the trap an additive composition;

wherein the additive composition consists of:

(a) at least one fuel-soluble or fuel-dispersible alkaline earth metal compound selected from the group consisting of calcium sulfonate and calcium salicylate, and (b) at least one fuel-soluble or fuel-dispersible transition metal compound including a transition metal selected from the group consisting of iron, copper, cerium, chromium, cobalt and molybdenum; and wherein the fuel oil composition contains at most 0.05 mass percent of sulfur, the total metal content of the alkaline earth metal compound and the transition metal compound in the fuel oil composition is at most 50 ppm by mass, the mass proportion of metal in the alkaline earth metal compound to metal in the transition metal compound is in the range of about 60:40 to about 95:5, the alkaline earth metal compound includes an organic anion and metal associated with the organic anion, the ratio of metal in the alkaline earth compound to metal associated with the organic anion is less than about 2, and the fuel composition does not comprise a manganese compound.

9. The process of claim 8 in which the additive composition consist of at least one fuel-soluble or fuel-dispersible neutral calcium sulfonate or calcium salicylate and at least one fuel-soluble or fuel-dispersible iron compound.

10. The process of claim 8 in which the transition metal compound is selected from the group consisting of a salt of an organic acid, ferrocene or a derivative of ferrocene.

11. The process of claim 10 in which the organic acid is selected from the group consisting of carboxylic acid, carboxylic acid anhydride, alcohol, phenol, sulfurized phenol, salicylic acid and sulfonic acid.

12. The process of claim 8 in which the transition metal compound is ferrocene.

13. The process of claim 8 in which the mass proportion of the alkaline earth metal compound to the transition metal compound, based on metal content, is in the range of about 70:30 to about 95:5.

14. A process for improving the regenerative ability of a particulate trap of a fuel oil composition device, which process consists of:

adding to the fuel oil combustion device a fuel oil composition incorporating an additive composition;

wherein the additive composition consists of:

(a) at least one fuel-soluble or fuel-dispersible alkaline earth metal compound selected from the group consisting of calcium sulfonate and calcium salicylate, and (b) at least one fuel-soluble or fuel-dispersible transition metal compound including a transition metal selected from the group consisting of iron, copper, cerium, chromium, cobalt and molybdenum; and wherein the fuel oil composition contains at most 0.05 mass percent of sulfur, the total metal content of the alkaline earth metal compound and the transition metal compound in the fuel oil composition is at most 50 ppm by mass, the mass proportion of metal in the alkaline earth metal compound to metal in the transition metal compound is in the range of about 60:40 to about 95:5, the alkaline earth metal compound includes an organic anion and metal associated with the organic anion, the ratio of metal in the alkaline earth compound to metal associated with the organic anion is less than about 2, and the fuel composition does not comprise a manganese compound.

15. The process of claim 14 in which the additive composition consist of at least one fuel-soluble or fuel-dispersible neutral calcium sulfonate or calcium salicylate and at least one fuel-soluble or fuel-dispersible iron compound.

16. The process of claim 14 in which the transition metal compound is selected from the group consisting of a salt of an organic acid, ferrocene or a derivative of ferrocene.

17. The process of claim 16 in which the organic acid is selected from the group consisting of carboxylic acid, carboxylic acid anhydride, alcohol, phenol, sulfurized phenol, salicylic acid and sulfonic acid.

18. The process of claim 14 in which the transition metal compound is ferrocene.

19. The process of claim 14 in which the mass proportion of the alkaline earth metal compound to the transition metal compound, based on metal content, is in the range of about 70:30 to about 95:5.

* * * * *